United States Patent [19]

Herrmann, Jr.

[11] 4,168,105

[45] Sep. 18, 1979

[54] RESILIENTLY LOADED COUPLING RING

[75] Inventor: Henry O. Herrmann, Jr., Mt. Joy, Pa.

[73] Assignee: AMP Incorporated, Harrisburg, Pa.

[21] Appl. No.: 919,512

[22] Filed: Jun. 27, 1978

[51] Int. Cl.[2] ..... H01R 13/54

[52] U.S. Cl. ..... 339/90 R; 339/89 M

[58] Field of Search ..... 339/89 R, 89 C, 89 M, 339/90 R, 90 C, 90 F; 285/87, 88, 401, 402, 360, 362; 85/32 CS, 32 T

[56] References Cited

U.S. PATENT DOCUMENTS

| | | | |
|---|---|---|---|
| 2,606,224 | 8/1952 | Modrey | 339/89 R X |
| 2,933,711 | 4/1960 | Eaton | 339/90 R |
| 2,958,844 | 11/1960 | Smith et al. | 339/89 R |
| 3,901,574 | 8/1975 | Paullus et al. | 339/90 R |
| 3,917,373 | 11/1975 | Peterson | 339/89 R |
| 4,072,385 | 2/1978 | Wallner | 339/90 F X |

FOREIGN PATENT DOCUMENTS

| | | | |
|---|---|---|---|
| 89440 | 11/1958 | Netherlands | 285/402 |

*Primary Examiner*—E. F. Desmond

*Attorney, Agent, or Firm*—Russell J. Egan

[57] ABSTRACT

An improved coupling ring is disclosed having unitary structure providing spring biased engagement between cooperating members. The coupling ring has a substantially cylindrical profile including, at one end, a rigid portion with inwardly directed helical latching grooves and, at the opposite end, an integral spring portion terminating with an inwardly directed annular flange. The members to be coupled are assembled with the coupling ring engaging a shoulder of one member by the flange and with the grooves receiving lugs fixed on the opposite member so that rotation of the ring will draw the members together and hold them together in a spring loaded condition.

4 Claims, 3 Drawing Figures

RESILIENTLY LOADED COUPLING RING

BACKGROUND OF THE INVENTION

1. The Field of the Invention

The present invention relates to a coupling ring and in particular to a unitary coupling ring for holding together the mating members of an electrical connector in a spring biased condition.

2. The Prior Art

Coupling rings are used throughout the electrical connector industry to insure that mating connector members are positively held together. The known connecting rings generally have one of two configurations, namely a screw or a bayonet configuration. The screw type are provided on one end with internal threads which are threadedly received on an externally threaded member. The bayonet type are provided with internal helical grooves for engaging fixed studs on the mating member with a simple twisting motion, which is not a complete circle. The opposite end of either type of ring is provided with an annular flange and the ring is freely rotatably mounted on one mating member. The bayonet type connectors are usually used for quick disconnect arrangements while the screw threaded type are used for positive engagement between connectors. An example of a bayonet type coupling ring can be found in U.S. Pat. No. 3,901,574 and an example of a screw type coupling ring can be found in U.S. Pat. No. 2,958,844.

There are times when it is desirable to have a resilient biasing of the connector members together. In the past this has been accomplished by forming a cylindrical coupling body and inserting a plurality of spring means, such as washers, therein. This type of assembly, however, is quite complex and expensive. An example of this type of coupling ring assembly may be found in U.S. Pat. No. 3,917,373.

SUMMARY OF THE INVENTION

The present invention relates to a unitary coupling ring which provides for biasing of the members coupled thereby. The subject coupling ring is an integral member formed of plastics material and has an overall cylindrical profile. A forward end of the ring is provided with at least one internal helical locking groove while the opposite rear end is provided with an inwardly directed flange on the end of a spring-like configuration formed by a plurality of parallel spaced rings interconnected by circumferentially offset lands. The coupling ring is mounted with the flange engaging a shoulder of one mating member and the spring-like rear end must be stretched for the groove to engage corresponding studs on the opposite mating member. Rotation of the ring draws the members into a biased latched condition.

It is therefore an object of the present invention to produce an improved resiliently loaded coupling ring which has a unitary structure.

It is a further object of the present invention to produce an improved one piece coupling ring which includes portions for engaging each member to be coupled and a portion for resiliently biasing together the members coupled thereby.

It is a further object of the present invention to produce a unitary resiliently loaded coupling ring which can be readily and economically manufactured.

The means for accomplishing the foregoing objects, and other advantages of the present invention, will become apparent to those skilled in the art from the following detailed description taken with reference to the accompanying drawings.

DETAILED DESCRIPTION OF THE PREFERRED EMBODIMENT

Figure 1:
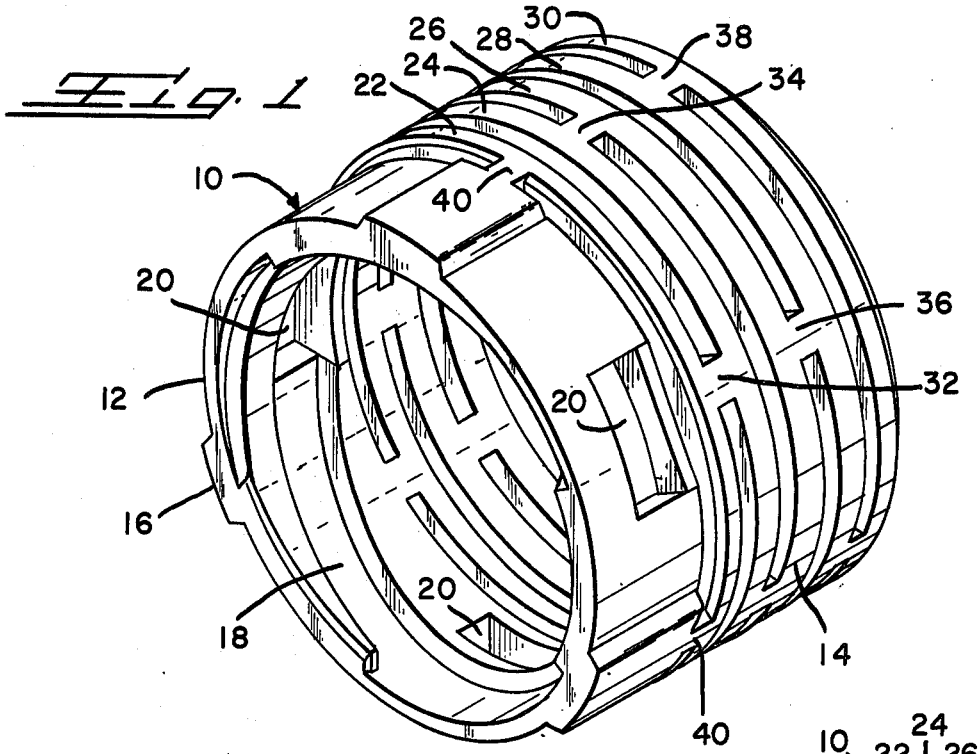
FIG. 1 is a perspective view of a coupling ring according to the present invention.
Figure 2:
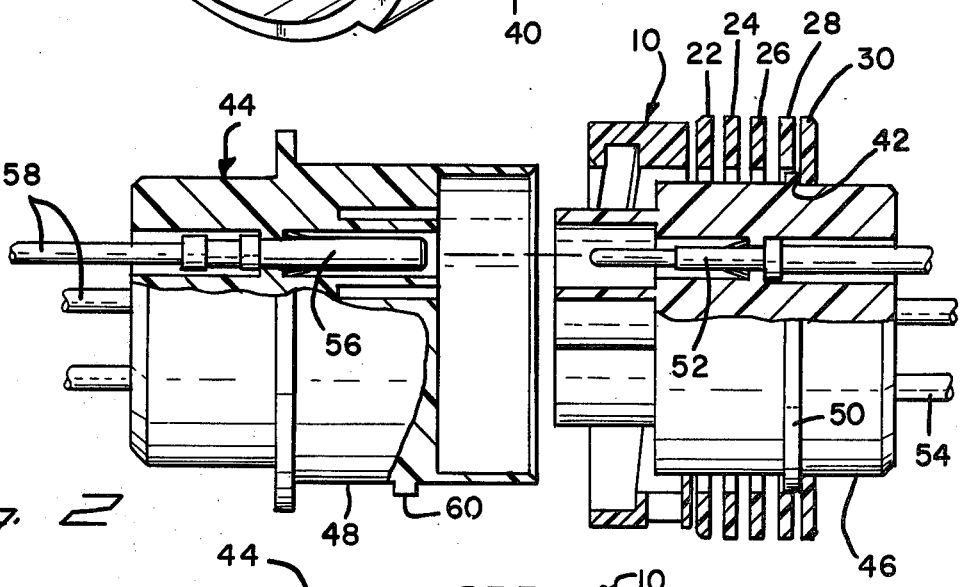
FIG. 2 is a side elevation, partially in section, of the subject coupling ring together with exploded mating electrical connector members.
Figure 3:
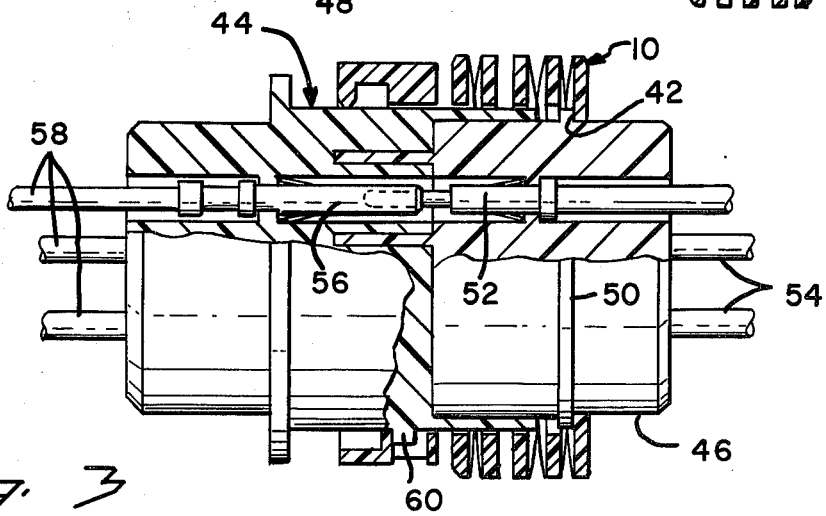
FIG. 3 is a side elevation, similar to FIG. 2, showing the connector members mated with the coupling ring securing them together.

The subject coupling ring 10 is a unitary member of plastics material and has a generally cylindrical profile. The ring includes a rigid front coupling end 12 and an integral rear resilient end 14. The front end 12 has a plurality of outwardly directed gripping projections 16 and at least one internal helical groove 18 terminated at its inner end by an aperture 20. The rear end 14 of the coupling ring is comprised of a plurality of parallel spaced rings 22, 24, 26, 28, 30 with adjacent rings interconnected by circumferentially offset lands 32, 34, 36, 38, with lands 40 interconnecting ring 22 and front end 12. The rear most ring 30 has a smaller inner diameter than the rest of the rings to form an inwardly directed annular flange or shoulder 42. There are several lands interconnecting each adjacent pair of rings with the lands on each side of each ring being circumferentially offset from each other. This allows each ring to be deformed in the plane defined by the ring, as shown in FIG. 3, thereby obtaining the desired resiliency.

The subject coupling ring would be mounted on an electrical connector 44 such as the one shown having a mating plug 46 and receptacle 48. The plug 46 has an outwardly directed integral shoulder or flange 50 and a plurality of pin terminals 52 mounted therein and terminating conductors 54. The receptacle 48 is profiled to receive the plug 46 and has a like plurality of receptacle terminals 56 mounted therein, terminating conductors 58, and at least one outwardly directed locking stud 60. The connector members 46 and 48 are brought together in the conventional manner to mate the respective terminals 52, 56. The coupling ring is then rotated to thread the stud 60 into a respective groove 18. The continued rotational movement of the coupling ring will cause the resilient rear end 14 of the coupling ring 10 to be expanded, as shown in FIG. 3, thereby holding the mated connectors together in a positive fashion.

The subject coupling ring can be formed from a wide variety of plastics materials chosen by mating their characteristics with the intended environment of the coupling ring. Examples of suitable materials are Valox 420, Relran 500 and Ryton R4.

While the subject coupling ring is shown for a bayonet type connection, the helical grooves 18 could be replaced by internal threads for effecting a screw type connection.

The present invention may be subject to many modifications and changes without departing from the spirit or essential characteristics thereof. The present embodiment should therefore be considered in all respects as being illustrative and not restrictive of the scope of the invention.

What is claimed is:

1. A resiliently loaded coupling ring comprising:

a unitary, substantially cylindrical body of plastics material having a coupling first end and a spring second end;

said coupling end having at least one internal helical groove; and said spring end having a plurality of rings interconnected by circumferentially spaced lands, the lands on each side of each ring being circumferentially offset, and the endmost of said rings having an inner diameter less than the remaining rings to form an annular latching shoulder.

2. The coupling ring according to claim 1 further comprising:

outwardly directed gripping means on said coupling portion.

3. The coupling ring according to claim 1 wherein each said helical groove terminates with an aperture through a sidewall of said coupling portion.

4. A coupling ring for holding a pair of mating members together in a resiliently loaded condition, said ring comprising:

a unitary body of plastics material having a substantially cylindrical profile defining a rigid first end and a resilient second end;

said first end having at least one internal helical groove and external gripping means, said second end having a plurality of rings interconnected in pairs by circumferentially offset lands, the lands on each side of each said ring likewise being circumferentially offset, and the ring on the free end of said body having an inner diameter less than that of the other rings to form an internal annular latching shoulder, whereby said members are held together in a loaded condition by said shoulder engaging a corresponding shoulder on one mating member and said groove engaging corresponding means on the other member with rotational movement of said ring drawing said members together while stretching said resilient end.

* * * * *